United States Patent [19]

Miller

[11] 3,947,370

[45] Mar. 30, 1976

[54] ELECTROPHOTOGRAPHIC DEVELOPING COMPOSITIONS

[75] Inventor: Howard A. Miller, Rochester, N.Y.

[73] Assignee: Eastman Kodak Company, Rochester, N.Y.

[22] Filed: Dec. 23, 1970

[21] Appl. No.: 101,153

Related U.S. Application Data

[63] Continuation of Ser. No. 562,497, July 5, 1966, abandoned.

[52] U.S. Cl. ..... 252/62.1 P; 96/1.5 D; 427/18; 427/20; 252/62.55

[51] Int. Cl.[2] ..... G03G 9/02

[58] Field of Search ..... 252/62.1, 500, 503, 511, 252/62.55; 117/100 R, 201, 227, 217, 230, 16; 96/1.5 D; 427/18, 20

[56] References Cited

UNITED STATES PATENTS 3,533,835 10/1970 Hagenbach et al. ..... 117/217

FOREIGN PATENTS OR APPLICATIONS 40-26,386 11/1970 Japan ..... 252/62.1

*Primary Examiner*—Jack P. Brammer
*Attorney, Agent, or Firm*—R. P. Hilst

[57] ABSTRACT

Electrostatic latent image developing compositions are disclosed which contain toner granules and carrier particles. The novel carrier particles are comprised of a dispersion of magnetically responsive particulate material in an electrically insulating material which is triboelectrically matched with the toner granules to be electrostatically attractive to the toner granules when mixed therewith.

7 Claims, No Drawings

ELECTROPHOTOGRAPHIC DEVELOPING COMPOSITIONS

This application is a continuation of Ser. No. 562,497, filed July 5, 1966 and now abandoned.

This invention relates to the development of electrostatic latent images, and in particular to the use of solid, magnetically responsive carrier particles in triboelectric developing compositions.

In xerographic processes, such as described in U.S. Pat. No. 2,297,691, a uniform electrostatic charge on the surface of a normally insulating, photoconductive layer is selectively discharged by exposure to a light image, leaving a complementary electrostatic image. This can be developed by treatment with a finely divided electroscopic powder or toner, which adheres in the image pattern. The toner is then fixed to the surface of the photoconductive layer by treatment with heat or solvent, or it can be transferred to a second support, making the photoconductive element available for reuse.

Toners may be selected to provide a variety of physical, chemical and optical differences between the image and nonimage areas. The toner usually contains a colorant to impart density or color to the copy. Opaque white toner is used in certain applications of xerography to radiography. Toners which produce an ink-receptive image are used to make lithographic printing plates by xerography.

The powdered toner may be applied to the exposed element in many ways. Commonly a developing composition is used, comprising the toner and a second material which serves as a carrier. In the electrostatic developing system with which this invention is concerned, the carrier takes the form of solid pellets or granules substantially larger than the individual grains of toner, each carrier particle being capable of bearing a large number of the smaller toner grains on its surface. The carrier and toner are oppositely charged so that the toner adheres strongly to the surface of the carrier. This electrostatic attraction is customarily produced triboelectrically, that is, by the friction generated in mixing the carrier particles and the powdered toner to make the developing composition.

The carrier particles can be small crystals of inorganic salts, tiny glass beads, resinous pellets, or the like. Magnetically responsive carrier particles, e.g., iron granules, can be used to enable deposition of the toner and/or removal of unused material by magnetic means. One application of such carriers is in magnetic brush development. In this method, as described in Greig U.S. Pat. No. 2,874,063, the triboelectric mixture of iron carrier particles and toner powder, held in a magnetic field, e.g., at one pole of a cylindrical DC-energized electromagnet, forms a resilient brush that is used to develop the image. As the magnetic brush is swept across the electrostatic image on the surface, the attraction between the toner and carrier is overcome and toner grains transfer from the carrier onto the electrostatic image. The carrier particles are retained by the magnetic brush and can be replenished with fresh toner when necessary.

Magnetic brush development is particularly useful in toning large electrostatic image areas. By properly grounding or biasing the magnetic brush, it is possible to produce uniform development across solid areas, in contrast to the fringe development obtained with the conventional cascade developing method.

Particulate iron which is customarily used as a carrier in magnetic-brush development can seriously affect the quality of development. Reusable xerographic materials, for example, selenium layers or resinous organic photoconductor coatings are easily abraded and the scratching produced by the iron greatly reduces the useful life of the photoconductive layer. Attempts to mitigate this problem by coating iron carrier particles with a nonabrasive material have not substantially improved the performance of these carriers.

The usefulness of the iron carrier is further limited by its electrical conductivity by which the image charge on the surface of the photoconductive element tends to be dissipated. The iron particles in intimate contact with a charged area can conduct charge away from the area, thus modifying the latent image and lowering the quality of the reproduced image.

It would also be desirable if the solid-carrier particles in xerographic developers were capable of being independently altered in shape, density, magnetic response, triboelectric characteristics, and electrical conductivity. Such flexibility would enable developer compositions to be designed for a wide number of specialized applications.

It is therefore an object of this invention to provide an improved magnetically responsive carrier material for use in triboelectric developing compositions for electrostatic images.

It is another object of this invention to provide a novel carrier material for use in magnetic-brush development of electrostatic images, which substantially reduces abrasion of the surface of a photoconductive element during development.

Another object of this invention is to provide a novel magnetically responsive carrier particle of this invention with an electrical conductivity which will not disturb an electrostatic image during development.

Another object of this invention is to provide a method for magnetic brush developing electrostatic charge patterns comprising as the toner carrying particle the magnetically responsive material of this invention.

A further object of this invention is to provide a novel developing composition for use in magnetic-brush development comprising a suitable toner material intimately mixed with the magnetic carrier particles of this invention.

Still another object of this invention is to provide a method of making the carrier particles of this invention whereby variations in the shape, specific gravity, resistivity and magnetic and triboelectric properties of the particles can readily be accomplished.

The above and further objects and advantages of this invention are achieved by providing an improved carrier particle comprising a homogeneous distribution of finely divided, magnetically electrical resistivity. Such a composition permits the preparation of carrier particles which are smooth and non-abrasive, and which display outstanding mechanical, magnetic, and electrostatic properties when the maximum dimension of the magnetically responsive particles is no more than one-fifth the maximum dimension of the ultimate carrier particle.

The carrier particles of this ivention can be of any desired shape; for example, they can be cylindrical, cubic, filamentary, plate like, disc shaped and the like.

The average carrier diameter (or effective maximum dimension) in triboelectric developing compositions ranges from about 600 to 100 microns (30 to 150 mesh). The carriers made according to this invention may be of any size within the range, or they may be larger or smaller to suit particular requirements. To prepare the carrier particles of this invention, the average diameter selected for the carrier particles should be at least 4 times the average diameter of the toner grains used with the carrier. The preferred developing compositions of this invention are comprised of uniformly sized carrier particles having an average diameter in the range of from about 125 microns to about 250 microns (about 120 to 60 mesh) and granular toner material having a maximum average grain diameter of about 25 microns. Excellent results are obtained with developing compositions made with toners and carriers within these size ranges, wherein the ratio of carrier particle diameter to toner grain diameter is at least 10 to 1.

The toner used with the carrier particles of this invention may be selected from a wide variety of materials to give desired physical properties to the developed image and the proper triboelectric relationship with the selected carrier.

Where the developers of the invention are to be used in magnetic-brush applications, a soft magnetic material can be employed, that is, one displaying, low remanence. In this manner the magnetism induced by an external magnetic field will substantially disappear when the field is removed. This property facilitates breaking up and reforming the magnetic brush. Suitable materials can be selected from iron, soft iron, chromium oxide and other magnetic oxides. Hard magnetic materials, such as gamma ferric oxide are otherwise satisfactory.

The individual bits of the ferromagnetic component should preferably be of a relatively uniform size and sufficiently smaller in diameter than the carrier particle to be produced, such that the surface of the carrier is substantially free of ferromagnetic material. Typically, the average diameter of the ferromagnetic bits should be no more than about 20 per cent of the average diameter of the carrier particle. Advantageously, a much lower ratio of average diameter of magnetizable component to carrier can be used. Excellent results are obtained with magnetizable powders of the order of 5 microns down to 0.05 microns average diameter. Even finer powders, such as colloidally fine "carbonyl iron" prepared by reduction of iron carbonyl, can be used when the degree of subdivision does not produce unwanted modifications in the magnetic properties and the amount and character of the selected binder produce satisfactory strength together with other desirable mechanical properties in the resulting carrier particle.

The concentration of the ferromagnetic component can vary widely. Carrier particles which can be retrieved readily by magnetic means and which can be used advantageously in magnetic-brush development can be prepared with proportions of finely divided magnetizable material, e.g., iron powder from about 20% by weight to about 95% by weight, in a suitable matrix.

The matrix material used with the finely divided magnetic inclusion is selected to provide the required mechanical and electrical properties. It should (1) adhere well to the ferromagnetic inclusion; (2) facilitate formation of strong, smooth-surfaces particles; and (3) possess sufficient difference in triboelectric properties from the toner grains with which it will be used to insure the proper polarity and magnitude of electrostatic charge between the toner and carrier when the two are mixed. When carrier particles are prepared as described herein, wearing of the particles will produce an exposed surface having triboelectric properties identical to those of the original surface. This property is due in part to the homogeneous structure of the carrier.

The insulating matrix can be glass, an inorganic salt, or the like. The matrix material is preferably a natural or synthetic resin or a mixture of such resins having appropriate mechanical and triboelectric properties. Other useful matrix materials include glass, inorganic salts, wood flour, paper pulp, powdered glass, textile fibers, and the like, either fuzed or combined with suitable adhesive addenda, such as, solvent-soluble or heat-softenable resins. Appropriate monomers (which can be used to prepare resins for this use) include, for example, vinyl monomers, such as, alkyl acrylates and methacrylates, styrene and substituted styrenes, basic monomers such as vinyl pyridines, etc. Copolymers prepared with these and other vinyl monomers, such as, acidic monomers, e.g., acrylic or methacrylic acid, can be used. Such copolymers can advantageously contain small amounts of polyfunctional monomers, such as, divinylbenzene, glycol dimethacrylate, triallyl citrate, and the like.

Preparation of carrier particles according to this invention may involve the application of heat to soften thermoplastic material, or to harden thermosetting material, evaporative drying to remove liquid vehicle; the use of pressure, or of heat and pressure, in molding, casting, extruding, etc., and in cutting or shearing to shape the carrier particles; grinding, e.g., in a ball mill to reduce carrier material to appropriate particle size; shifting operations to classify the particles; and the use of chemical operations, such as, polymerization.

According to one embodiment of the invention, the powdered ferromagnetic component is dispersed in a dope or solution of the binder resin. The solvent may then be evaporated and the resulting solid mass subdivided by grinding and screening to produce carrier particles which will pass through a 60 mesh screen but be retained by a 120 mesh screen.

According to another embodiment, emulsion polymerization is used to produce uniform carrier particles of excellent smoothness and useful life. In this method, a suitable magnetically responsive particulate solid, such as powdered iron, is dispersed in a viscous solution of a monomer or a mixture of monomers, optionally containing some polymer thickener. The resulting liquid can be emulsified in a viscous aqueous solution of hydrophilic protective colloid, and polymerized to form hard beads of resin containing uniformly dispersed magnetizable powder. The beads can be separated after polymerization and graded by screening, or they can be reduced in size in a ball mill and then graded, if desired.

Compositions of this invention make it possible to adjust the resistivity of the magnetic brush carrier over a wide range by incorporating nonmagnetic conductive material in the carrier matrix. For example, if the higher electrophotographic speed inherent in fringe development is desired in a system employing magnetic brush development, a carrier comprising magnetically responsive material in an insulating matrix can be used. If, however, solid-area development is desired, such as is obtainable with conventional soft iron carriers, an appropriate conductor can be dispersed in the matrix to lower the resistivity sufficiently to produce excellent solid-area development without the disturbance of the electrostatic image which is occasioned by the use of an untreated iron carrier.

The following examples illustrate preferred embodiments of this invention.

EXAMPLE I

A 50 g quantity of soft iron powder of a size which passed through a 60 mesh screen but was retained by a 120 mesh screen was washed thoroughly with ligroin and air dried. This was identified as Sample I. A further 200 g. quantity of soft iron powder (similarly cleaned and dried) graded to a size which passed a 90 mesh screen but was retained by a 120 mesh screen was coated with 40 g of a mixture of two parts of Vinylite VYNS resin (a medium-high molecular weight poly(vinyl acetate/vinyl chloride) composed of approximately 90 per cent vinyl chloride and 10 per cent vinyl acetate, Union Carbide Corp.) and three parts of Melmac 401 resin (a melamine type synthetic resin made by American Cyanamide Co.). These were bonded to the surface with 5 g of Bakelite resin BR7534 (supplied by Union Carbide Corp.) using 18% HCl solution as the catalyst. A third quantity of soft iron powder was graded to an average diameter of 2$\mu$. 200 g of this powder was intimately mixed with the same resin mixture used in preparing Sample II, the catalyst added, and heat applied to produce a hard resinous mass. This was ground to a coarse powder, graded to 60–120 mesh, and identified as Sample III. Sample I, II, and III were each used as carriers to make a triboelectric developing composition, by mixing 20 g of each with 1 g of toner of 15$\mu$ average diameter of the following composition:

90% polystyrene
10% carbon black

EXAMPLE 2

Five-gram quantities of the three developers in Example 1 were used to prepare magnetic brushes and rubbed repeatedly over 2 inch by 4 inch strips of two xerographic plates arranged at the bottom of a shallow tray. One of the plates was a selenium coating on aluminum, the other an organic photoconductor, triphenylamine, in a poly(styrene-methylmethacrylate) binder on aluminum. The two kinds of xerographic plates, representing 500 passes of the three magnetic-brush developers were examined by specular illumination at 50-power magnification. Severe abrasion was observed on both plates which had been treated with the iron carrier developer; less pronounced but still strongly evident abrasion occurred with the spraycoated iron. Microscopic examination of this carrier showed numerous sharp edges and points which would be expected to cause mechanical damage in the frictional contact involved in magnetic-brush development. The plates developed using the carrier of this invention showed almost no evidence of abrasion.

EXAMPLE 3

Four compositions were prepared like Sample III of the preceding example using the following homogeneous additions of finely divided electrically conducting material to modify the resistivity of the resulting carrier particles.

| | | % Conducting Carbon Based on Dry Weight of Resin |
|---|---|---|
| I | (Control) | 0 |
| II | | 4 |
| III | | 12 |
| IV | | 36 |

The four samples were used to prepare triboelectric developing compositions using the toner of Example 1. They were then employed in magnetic-brush development to treat identical negative electrostatic images on zinc oxide-resin electrophotographic paper. (Copytron Premium Paper A2813, sold by Charles Bruning Co., Division of Addressograph- Multigraph Corp.) Fringe development was obtained with Sample I and II. Low density area development with higher density at the edges occurred with Sample III. As expected, good uniform area development was obtained with Sample IV due to its greater conductivity.

EXAMPLE 4

A 15% by weight dope of poly(methyl methacrylate) in monomeric methyl methacrylate was made by stirring the materials together. To two parts of this dope was added with stirring one part of gamma iron oxide powder, 1 micron average diameter. The mixture was triturated until smooth with a mortar and pestle, and kept at a workable consistency by dilution with one additional part of monomer. The mixture was strained through cheese cloth, and 0.5% of lauroyl peroxide (by weight based on total weight of mixture) was added with stirring. The result was a smooth viscous dope. 170 g of a three per cent aqueous solution of cellulose methyl ether was heated to 50°C. To this slightly gelatinous solution in an 8-ounce bottle was added 34 g of the above pigmented monomer-polymer dope. The bottle was capped, shaken 30 times back and forth, and left overnight at 50°C. During this time, the monomer polymerized and the dope set to a soft gel. The contents of the bottle were cooled and dispersed in three volumes of distilled water. The resin particles settled readily. They were washed in several changes of water, filtered, and dried. The yield was nearly quantitative. The particles, which ranged in size from about 40 to about 400 microns, were classified and those in the size range from about 125 to about 250 microns were retained.

EXAMPLE 5

A portion of the iron oxide-polymer-monomer dope prepared in Example 4 was treated in the same way except that instead of shaking by hand, the mixture was stirred for ten minutes with 1.5-inch three-bladed propeller at 1750 rpm. The beads obtained were mostly 75 to 250 microns in their largest dimension.

EXAMPLE 6

A 15% by weight dope of polyvinyl pyridine in monomeric vinyl pyridine was made by stirring. To two parts of this dope, one part by weight of finely divided magnetite (Mapico Black, made by Columbia Carbon Company, particles less than 1 micron in diameter) was added with stirring. The mixture was ground smooth with a mortar and pestle, and was kept at a workable consistency by dilution with one additional part of monomer. The mixture was strained through cheese cloth, and 0.5% of lauroyl peroxide (by weight based on total weight of mixture) was added with stirring. The result was a smooth viscous black dope. In a 250 ml bottle, 170 g of a 3% by volume aqueous solution of cellulose methyl ether was heated to 50°C in a water bath. The solution became viscous and gelatinous. To this was added 34 g of the above pigmented monomer-polymer dope. The bottle was capped and was shaken moderately by hand 30 times back and forth. The bottle was then left overnight (18 hours) in the 50°C bath. During this time, the monomer polymerized and the dope set to a soft gel. The contents of the bottle were cooled and dispersed in three volumes of distilled water. The beads settled readily. They were washed in several changes of water, filtered and dried. The yield was nearly quantitative. They were round, smooth and black, mostly of diameter 40 to 400 microns, and were strongly attracted to a magnet.

EXAMPLE 7

Some of the magnetite-polymer-monomer dope from Example 6 was treated in the same way except that instead of shaking by hand, the mixture was stirred for 10 minutes with a 1.5-inch three-bladed propeller at 1750 rpm. The beads, isolated as in Example 6, were similar except they were finer and somewhat less uniformly spherical. They were mostly 75 to 250 microns in diameter.

EXAMPLE 8

To 60 g of magnetically responsive carrier material having a particle size classified between 60 and 120 mesh prepared as in Example 4, 3 g of toner having the following composition of about 10$\mu$ average particle size was added.

| | |
|---|---|
| Carbon Black | 3 g |
| Nigrosin (spirit jet) (a dyestuff sold by General Aniline and Film Co.) | 3 g |
| Iosol Black (dyestuff sold by Allied Chemical and Dye Corp.) | 2 g |
| Piccolastic Record Resin (polystyrene homolog, Pennsylvania Industrial Chemical Co.) | 92 g |

A developing composition of positively charged toner on a negatively charged carrier was triboeletrically produced by shaking the mixture in a covered glass jar. Prints made in the following manner with the above composition exhibited clean backgrounds and were generally of good overall quality.

An electrostatic latent image was produced on a negatively charged zinc oxide-resin electrophotographic paper (Copytron Premium Paper A2813, sold by Charles Bruning Co., Division of Addressograph-Multigraph Corp.) by imagewise exposure in a copy camera for 15 foot candle seconds and then toned with a manually operated magnetic brush containing the developer. The paper was placed, during toning, on a grounded aluminum plate. Similarly, development of a negative electrostatic latent image on an organic photoconductor layer consisting of triphenylamine in Vitel (a modified polyethylene terephthalate sold by Goodyear Tire and Rubber Co.) binder was accomplished using manual magnetic brush development. This was repeated with cascade development by flowing the tonercarrying particles over the surface of the paper. Good images were produced.

EXAMPLE 9

A quantity of magnetically responsive carrier material prepared according to Example 4 was ground to a coarse powder and screen classified to select a range of particles having a size between 30 and 60 mesh for use as the carrier. Fourteen grams of the toner used in Example 8 were mixed with 280 g of the carrier to form a composition with triboelectric properties from which a magnetic brush was formed on a mechanically driven magnet. The brush was operated at 120 rpm. Good xerographic prints were produced on a zinc oxide-resin paper such as used in Example 8 by charging on an aluminum plate under a multiwire charger and exposing with a copy camera. During development a 6.0 kilovolt potential was applied between the brush roller and a single 0.003-inch tungsten wire located behind the electrophotographic paper.

EXAMPLE 10

The procedure of Example 9 was repeated, using as the xerographic element, an acetate support coated with a conducting layer comprising cuprous iodide in polyvinyl acetate which had been overcoated with a photoconductive layer comprising triphenylamine in a Vitel (Goodyear Tire and Rubber Co.) binder. The element was exposed by reflex to a positive document, and developed with a magnetic brush containing the developer. A satisfactory xerographic print resulted.

EXAMPLE 11

Ten grams of Butvar B-76 (a medium molecular weight terpolymer composed of about 88 per cent polyvinyl butyral, 2.5 per cent polyvinyl acetate and 9 to 13 per cent polyvinyl alcohol made by Shawinigan Resins Division of Monsanto Chemical Co.) were stirred in 500 ml of 1:1 acetone-methyl isobutyl ketone solvent at 100°F until the resin dissolved. Forty-five grams finely divided $Fe_3O_4$ pigment (average diameter 3 microns) were added with stirring and the suspension was milled in a ball mill for 72 hours. It was then poured onto a clean glass surface to form a thin film of approximately 0.0015 dry thickness and the solvent was removed by evaporation. The solid layer was stripped and triturated to a particle size which passed 60 but was retained by 120 mesh sieve. The resulting flat platelets were mixed with toner as in Example 8. This triboelectric developing composition was used in magnetic brush and cascade development techniques as in Example 8 to develop electrostatic latent images. These procedures yielded good quality prints.

EXAMPLE 12

A ball-milled ferromagnetic carrier as prepared in Example 11 was ground to larger than 20–30 screen size and used as the carrier for 5 per cent by weight of the toner of Example 8 graded by elutriation to a 15$\mu$ maximum size. A sheet of the xerographic material used in Example 10 was charged negatively with 9.0 kilovolt corona for 6 seconds, exposed in a copy camera for 15 foot candle seconds and developed by magnetic brush using the above mix. The image was transferred to a paper receiving sheet made by the Georgia-Pacific Company, Hopper Paper Division, the photoconductor cleaned with a soft cotton pad, and the cycle repeated several times. Prints of good quality were obtained each time.

EXAMPLE 13

The procedure of Example 12 was repeated using 60–120 mesh size carrier particles. Successive images were transferred to Verifax Copy Paper (Eastman Kodak Co.), and to the paper used in Example 12. Images on both papers had high maximum density and low background density.

EXAMPLE 14

The procedure in Example 8 was repeated using as the carrier particles ground to an average size of 90 mesh from a tough, resilient composition made by incorporating 60 grams of $\gamma$-$Fe_2O_3$ (the largest grains passing through 200 mesh) in 10 grams of a copolymer of 90 per cent ethyl acrylate and 10 per cent 2-methyl-5-vinylpyridine. Good xerographic prints were obtained.

EXAMPLE 15

Example 14 was repeated using as the carrier, 90 grams of carbonyl iron SF (less than 0.5$\mu$ diameter; General Aniline and Film Corp.) in 10 g of Butvar resin. Good prints were obtained on zinc oxide-resin xerographic paper.

EXAMPLE 16

Carrier particles of size ranging from 75 to 250 microns in diameter were prepared as described in Example 5. Fifty grams of these granules were shaken with 2.5 g of the toner described in Example 8 and the resulting triboelectric developer was used to tone electrostatic images on the zinc oxide-resin paper used in Example 10. Prints of good quality were obtained.

EXAMPLE 17

A 15 per cent-by-weight dope of poly(methyl methacrylate) in monomeric methyl methacrylate was made by stirring. To two parts of this dope was added, with stirring, one part by weight of finely divided soft iron havng a particle size less than 1 micron. The mixture was ground smooth with a mortar and pestle, and was kept at a workable consistency by dilution with one additional part of monomer. The mixture was strained through cheese cloth, and 0.5 per cent of lauroyl peroxide (by weight based on total weight of mixture) was added with stirring. The result was a smooth viscous black dope. In a 250 ml bottle, 170 g of a 3 per cent by volume aqueous solution of cellulose methyl ether was heated to 50°C in a water bath. The solution became more viscous and slightly gelatinous. To this was added 34 g of the above pigmented monomer-polymer dope. The bottle was capped and was shaken moderately by hand 30 times back and forth. The bottle was then left overnight (18 hours) in the 50°C bath. During this time the monomer polymerized and the dope set to a soft gel. The contents of the bottle were cooled and dispersed in three volumes of distilled water. The beads settled readily. The were washed in several changes of water, filtered, and dried. This material, when processed according to Example 8, produced prints of good quality on zinc oxide-resin coated papers as in Example 10.

EXAMPLE 18

Forty grams of Butvar B-76 (see Example 11) were dissolved in 350 cc of methyl isobutyl ketone in a Waring Blendor. 37.8 g of Vulcan XC-72R carbon (made by Cabot Corp.) were added to the solution. This dispersion was added to 750 g of ferromagnetic material having a particle size less than 1 micron and shaken gently. The dispersion was dried, ground, and sieved to 60–120 mesh. To the carrier was added 5 per cent by weight of the toner described in Example 5. An image was developed and transferred as in Example 12, yielding a print of good quality. An additional quantity of this liquid composition was evaporated to a nearly gelled state, extruded through round openings of approximately 100 micron diameter, the extruded material being cut to approximately 500 micron lengths. The resulting cylinders were treated with a rising current of heated air which dried the material to a solid, nontacky state, before it settled to the bottom. The particles were used to prepare magnetic-brush developers which yielded excellent fringe-developed images.

EXAMPLE 19

The method of Example 18 was used to make a carrier, using as the components:

| | |
|---|---|
| Bakelite VYHH resin* (Union Carbide Corp.) | 36 g |
| Methyl isobutyl ketone | 120 g |
| Carbonyl iron SF (General Aniline and Film Corp.) | 210 g |

*Bakelite VYHH resin is a medium molecular weight copolymer composed of approximately 87 per cent vinyl chloride and 13 per cent vinyl acetate.

To the ground and sieved carrier was added 10 per cent by weight of the toner of Example 8. The process of Example 12 yielded a print of good quality.

EXAMPLE 20

The method of Example 14 was used to make a carrier using instead the following components:

| | |
|---|---|
| Bakelite VAGH resin** (Union Carbide Corp.) | 38.5 g |
| Methyl ethyl ketone | 45.0 g |
| Methyl isobutyl ketone | 255.0 g |
| Vulcan XC-72R carbon (Cabot Corp.) | 10.0 g |
| $\gamma$-$Fe_2O_3$ (K-300, less than 1 micron in size made by American Pigment Co.) | 116.0 g |
| Tenlo 70 (a nonionic surfactant made by Nopco Chemical Co., Newark, New Jersey) | 2.0 g |

**Bakelite VAGH resin is a partially hydrolyzed vinyl chloride vinyl acetate copolymer having a vinyl chloride content of approximately 91 per cent.

To the ground and sieved carrier was added 5 per cent of the toner of Example 8. The process of Example 12 yielded a print of good quality.

EXAMPLE 21

The composition of Example 20 was prepared, with the exception that the VAGH resin was in part replaced with Butvar76resin, as follows:

| | |
|---|---|
| Bakelite VAGH resin | 25.0 g |
| Butvar-76 resin | 13.5 g |

This composition gave a material having mechanical properties superior to those obtained when either resin was used alone. When this carrier was mixed with 5 weight per cent of the toner of Example 8, and an image made as in Example 12, a print of good quality was obtained.

EXAMPLE 22

The procedure of Example 11 was followed except that the concentration of iron oxide was raised to 10 g and 40 g of wood flour were added. The resulting carrier particles produced good triboelectric developers which gave fringe development in both cascade and magnetic-brush systems.

EXAMPLE 23

300 grams of finely powdered soda lime glass and 550 g of gamma ferric oxide powder were uniformly mixed and heated to produce a uniform melt. While agitation was continued the molten mixture was blown through a nozzle, impinging on a stainless steel plate heated to 200°C. The resulting finely divided droplets were then allowed to drop into a beaker containing hot mineral oil. The resulting nearly spherical beads were collected, washed with petroleum ether, dried, graded for size and used as carrier particles to prepare developers for both cascade and magnetic-brush uses. Good fringe-developed images were obtained with no background toning. The procedure was repeated adding stannous oxide to make the glass conducting. The resulting beads graded to 60–90 mesh were used to prepare magnetic-brush developers, which gave good solid area development.

The binder containing the ferromagnetic dispersion will ordinarily form the entire carrier particle. It can, however, be overcoated with a layer of insulating material which is free of ferromagnetic particles, e.g., a lacquer or the ferromagnetic material may be dispersed in an outer layer over a core of different composition, e.g., a glass bead, paper pellet, etc.

The invention has been described in detail with particular reference to preferred embodiments thereof, but it will be understood that variations and modifications can be effected within the spirit and scope of the invention as described hereinabove and as defined in the appended claims.

I claim:

1. An electroscopic developer composition comprising a mixture of toner particles and carrier particles wherein the carrier particles comprise a homogeneous dispersion of magnetically responsive particulate material in an electrically insulating material which is triboelectrically matched with the toner particles to be electrostatically attractive to the toner particles when mixed with them, the average diameter of said magnetically responsive particulate material being not greater than 20 percent of the average diameter of the carrier particles, said carrier particles having an average diameter of from about 100 microns to about 600 microns which is at least 4 times the average diameter of the toner particles.

2. An electroscopic developer cmposition according to claim 1 wherein said magnetically responsive particulate material is selected from the group consisting of gamma iron oxide, magnetic iron oxide, soft iron, ferromagnetic alloys containing iron, and mixtures thereof.

3. In a dry electroscopic developer composition for use in development of electrostatic charge patterns, said composition comprising a triboeletric mixture of electroscopic toner particles and magnetically attractive carrier particles, said carrier particles having an average diameter of from about 100 microns to about 600 microns, said average diameter being at least 4 times the average diameter of said toner particles, the improvement wherein said carrier particles are each comprised of a homogeneous dispersion of a plurality of separate, magnetically responsive particles in a solid, cohesive, non-metallic, electrically insulating matrix which is triboelectrically matched to be electrostatically attractive to said toner particles, said separate, magnetically responsive particles having an average diameter not greater than about 20 percent of the carrier particle in which they are contained.

4. A developer composition as in claim 2 wherein said matrix is formed of an organic, electrically insulating, film-forming polymer and said separate, magnetically responsive particles contained therein have an average diameter of not greater than about 40 microns.

5. A developer composition as in claim 2 wherein said carrier particles are present in an amount of at least about 90 percent by weight of the electroscopic developer composition.

6. A developer composition as described in claim 2 wherein said separate, magnetically responsive particles comprise a ferromagnetic material selected from the group consisting of gamma iron oxide, magnetic iron oxide, soft iron, ferromagnetic alloys containing iron, and mixtures thereof.

7. A developer composition as described in claim 2 wherein said carrier particles contain from about 20% to about 95% of magnetically responsive particles having a low remanence.

* * * * *

UNITED STATES PATENT AND TRADEMARK OFFICE

CERTIFICATE OF CORRECTION

PATENT NO. : 3,947,370

DATED : March 30, 1976

INVENTOR(S) : Howard A. Miller

It is certified that error appears in the above-identified patent and that said Letters Patent are hereby corrected as shown below:

Column 2, line 56, before "electrical", ---responsive particles in a shaped, solid matrix of controlled--- should be inserted; line 64,"ivention" should read ---invention---.

Column 3, line 46, "0.05 microns" should read ---0.05 micron---; line 52, "desirable" should read ---desired---; line 66, "smooth-surfaces" should read ---smooth-surfaced---.

Column 7, lines 66-67, "tonercarrying" should read ---toner-carrying---.

Column 9, line 41, "havng" should read ---having---; line 59, "The were" should read ---They were---.

Column 10, line 46, after "5", ---weight--- should be inserted; line 54, "Butvar76resin" should read ---Butvar-76 resin---.

Column 12, line 5, "cmposition" should read ---composition---; line 28, "2" should read ---3---; line 33, "2" should read ---3---; line 37, "2" should read ---3---; line 43, "2" should read ---3---.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*